US006425812B1

(12) United States Patent
Pant et al.

(10) Patent No.: US 6,425,812 B1
(45) Date of Patent: Jul. 30, 2002

(54) POLISHING HEAD FOR CHEMICAL MECHANICAL POLISHING USING LINEAR PLANARIZATION TECHNOLOGY

(75) Inventors: Anil K. Pant, Santa Clara; Douglas W. Young; Glenn Travis, both of Sunnyvale; Konstantin Volodarsky, San Francisco; Andrew Nagengast, Sunnyvale, all of CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 09/475,543

(22) Filed: Dec. 30, 1999

Related U.S. Application Data

(63) Continuation-in-part of application No. 08/838,381, filed on Apr. 8, 1997, now Pat. No. 6,244,946.

(51) Int. Cl.[7] ..... B24B 7/22
(52) U.S. Cl. ..... 451/307; 451/398; 451/388
(58) Field of Search ..... 451/288, 289, 451/287, 41, 307, 398, 388

(56) References Cited

U.S. PATENT DOCUMENTS

| | | | |
|---|---|---|---|
| 2,606,405 | A | 8/1952 | Ohl |
| 3,579,916 | A | 5/1971 | Boettcher |
| 3,631,634 | A | 1/1972 | Weber |
| 3,691,694 | A | 9/1972 | Goetz et al. |
| 3,708,921 | A | 1/1973 | Cronkhite et al. |
| 3,731,435 | A | 5/1973 | Boettcher et al. |
| 3,747,282 | A | 7/1973 | Katzke |
| 3,833,230 | A | 9/1974 | Noll |
| 3,886,693 | A | 6/1975 | Tajnafol et al. |
| 3,888,053 | A | 6/1975 | White et al. |
| 3,924,361 | A | 12/1975 | White et al. |
| 3,986,433 | A | 10/1976 | Walsh et al. |

(List continued on next page.)

FOREIGN PATENT DOCUMENTS

| | | |
|---|---|---|
| EP | 0 284 343 A3 | 9/1988 |
| EP | 0 362 811 A3 | 4/1990 |
| EP | 0 589 433 A1 | 3/1994 |
| EP | 0 747 167 A2 | 12/1996 |
| EP | 0 768 148 A1 | 4/1997 |
| JP | 55-157473 | 12/1980 |
| JP | 59-187456 | 10/1984 |
| JP | 63200965 | 8/1988 |
| JP | 63251166 | 10/1988 |
| JP | 6-91522 | 4/1994 |

OTHER PUBLICATIONS

Copy of claims for co–pending U.S. application Ser. No. 09/540,603 filed Mar. 31, 2000.

Copy of claims for co–pending U.S. application Ser. No. 09/672,605 filed Sep. 29, 2000.

Copy of claims for co–pending U.S. application Ser. No. 09/789,346 filed Feb. 20, 2001.

Abstract for DE 2442081 A., *Two Disc Lapping Machine,* Mar. 18, 1975.

Abstract, Hause, Jr. R. et al.: *Lapping Machine With Soft Carriers;* Jul. 1980.

U.S. patent application Ser. No. 09/540,603, Travis, Glenn W., filed Mar. 31, 2000.

*Primary Examiner*—Robert A. Rose
(74) *Attorney, Agent, or Firm*—Brinks Hofer Gilson & Lione

(57) ABSTRACT

A polishing head for performing chemical-mechanical polishing on a linear polisher has a flexible diaphragm coupling between a wafer carrier and a support housing which houses the wafer carrier. The diaphragm allows the carrier to move-substantially in the vertical direction within the housing, but a center shaft assembly limits movement in the horizontal direction.

31 Claims, 5 Drawing Sheets

U.S. PATENT DOCUMENTS 4,009,539 A 3/1977 Day
4,020,600 A 5/1977 Day
4,098,031 A 7/1978 Hartman
4,132,037 A 1/1979 Bonora
4,141,180 A 2/1979 Gill, Jr. et al.
4,193,226 A 3/1980 Gill, Jr. et al.
4,194,324 A 3/1980 Bonora et al.
4,256,535 A 3/1981 Banks
4,270,316 A 6/1981 Kramer et al.
4,283,242 A 8/1981 Regler et al.
4,313,284 A 2/1982 Walsh
4,316,757 A 2/1982 Walsh
4,373,991 A 2/1983 Banks
4,450,652 A 5/1984 Walsh
4,459,785 A 7/1984 Zimmer
4,502,252 A 3/1985 Iwabuchi
4,512,113 A 4/1985 Budinger
4,519,168 A 5/1985 Cesna
4,680,893 A 7/1987 Cronkhite et al.
4,693,036 A 9/1987 Mori
4,711,610 A 12/1987 Riehl
4,753,049 A 6/1988 Mori
4,811,522 A 3/1989 Gill, Jr.
4,897,966 A 2/1990 Takahashi
4,918,869 A 4/1990 Kitta
4,918,870 A 4/1990 Torbert et al.
4,944,119 A 7/1990 Gill, Jr. et al.
5,035,087 A 7/1991 Nishiguchi et al.
5,036,630 A 8/1991 Kaanta et al.
5,081,795 A 1/1992 Tanaka et al.
5,095,661 A 3/1992 Gill, Jr. et al.
5,121,572 A 6/1992 Hilscher
5,193,316 A 3/1993 Olmstead
5,205,082 A 4/1993 Shendon et al.
5,230,184 A 7/1993 Bukhman
5,238,354 A 8/1993 Volovich
5,257,478 A 11/1993 Hyde et al.
5,297,361 A 3/1994 Baldy et al.
5,329,732 A 7/1994 Karlsrud et al.
5,335,453 A 8/1994 Baldy et al.
5,361,545 A 11/1994 Nakamura
5,377,451 A 1/1995 Leoni et al.
5,398,459 A 3/1995 Okumura et al.
5,404,678 A 4/1995 Hasegawa
5,421,769 A 6/1995 Schultz et al.
5,423,558 A 6/1995 Koeth et al.
5,423,716 A 6/1995 Strasbaugh
5,441,444 A * 8/1995 Nakajima ..... 451/289
5,443,416 A 8/1995 Volodarsky
5,449,316 A 9/1995 Strasbaugh
5,476,414 A 12/1995 Hirose et al.
5,486,129 A 1/1996 Sandhu et al.
5,507,614 A 4/1996 Leonov et al.
5,527,209 A 6/1996 Volodarsky et al.
5,558,568 A 9/1996 Talieh et al.
5,562,524 A 10/1996 Gill, Jr.
5,567,199 A 10/1996 Huber et al.
5,571,044 A 11/1996 Bolandi et al.
5,575,706 A 11/1996 Tsai et al.
5,575,707 A 11/1996 Talieh et al.
5,582,534 A 12/1996 Shendon et al.
5,584,746 A 12/1996 Tanaka et al.
5,584,751 A 12/1996 Kobayashi et al.
5,593,344 A 1/1997 Weldon et al.
5,607,341 A 3/1997 Leach
5,624,299 A 4/1997 Shendon
5,635,083 A 6/1997 Breivogel et al.
5,692,947 A * 12/1997 Talieh et al. ..... 451/307
5,716,258 A * 2/1998 Metcalf ..... 451/41
5,762,544 A * 6/1998 Zuniga et al. ..... 451/289
5,803,799 A 9/1998 Volodarsky et al.
5,857,899 A 1/1999 Volodarsky et al.

* cited by examiner

POLISHING HEAD FOR CHEMICAL MECHANICAL POLISHING USING LINEAR PLANARIZATION TECHNOLOGY

CROSS-REFERENCE TO RELATED APPLICATIONS

This is a continuation-in-part (CIP) application of Ser. No. 08/838,381, filed on Apr. 8, 1997 now U.S. Pat. No. 6,244,946 and titled "Polishing Head With Removable Subcarrier," the entire specification of which is incorporated by reference herein.

BACKGROUND

1. Field of the Invention

The present invention relates to the field of semiconductor wafer processing and, more particularly, to polishing heads for use in the chemical-mechanical polishing of semiconductor wafers.

2. Background of the Related Art

The manufacture of an integrated circuit device requires the formation of various layers (both conductive and non-conductive) above a base substrate to form the necessary components and interconnects. During the manufacturing process, removal of a certain layer or portions of a layer must be achieved in order to pattern and form various components and interconnects. Chemical mechanical polishing (CMP) is being extensively pursued to planarize a surface of a semiconductor wafer, such as a silicon wafer, at various stages of integrated circuit processing. It is also used in flattening optical surfaces, metrology samples, and various metal and semiconductor based substrates.

CMP is a technique in which a chemical slurry is used along with a polishing pad to polish away materials on a semiconductor wafer. The mechanical movement of the pad relative to the wafer in combination with the chemical reaction of the slurry disposed between the wafer and the pad, provide the abrasive force with chemical erosion to polish the exposed surface of the wafer (or a layer formed on the wafer), when subjected to a force pressing the wafer onto the pad. In the most common method of performing CMP, a substrate is mounted on a polishing head which rotates against a polishing pad placed on a rotating table (see, for example, U.S. Pat. No. 5,329,732). The mechanical force for polishing is derived from the rotating table speed and the downward force on the head. The chemical slurry is constantly transferred under the polishing head. Rotation of the polishing head helps in the slurry delivery as well in averaging the polishing rates across the substrate surface.

Another technique for performing CMP to obtain a more uniform polishing rate is the use of a linear polisher. Instead of a rotating platen and pad, a moving belt is used to linearly move the pad across the wafer surface. The wafer is still rotated for averaging out the local variations, but the global planarity is improved over CMP tools using rotating pads. An example of a linear polisher is the TERES polisher available from Lam Research Corporation of Fremont, Calif.

Unlike the hardened table top of a rotating polisher, linear polishers are capable of using flexible belts, upon which the pad is disposed. This flexibility allows the belt to flex, which can cause a change in the pad pressure being exerted on the wafer. When this flexibility can be controlled, it provides a mechanism for controlling the polishing rate and/or the profile. Accordingly, a fluid platen can be readily utilized to control the pad pressure being exerted on a wafer at various locations along the wafer surface. Examples of fluid platens are found in the aforementioned TERES polisher and in U.S. Pat. No. 5,558,568.

With either type of polisher (linear or rotary), the polishing head is an important component of the polishing tool. The polishing head provides means for holding and supporting the wafer, rotating the wafer and transmitting the polishing force to engage the wafer against the pad. Generally, the polishing head includes a housing in which a wafer carrier resides. The wafer carrier and/or the head housing is coupled to a rotating mechanism so that the wafer can rotate.

The wafer is mounted on the carrier and held in place by a retainer element, such as a wafer retaining ring. A thin seating material (insert) may be utilized on the mounting surface of the carrier to cushion the seating of the wafer. When in operation, the carrier may have one or more height positions. For example, one height position relative to the housing can be for the mounting of the wafer onto the carrier assembly, while a second height position of the carrier is used when the wafer is to engage the polishing pad.

Generally, when the wafer is being polished, the downforce exerted by the polishing head assembly should be of sufficient magnitude to press the wafer onto the pad so that CMP can be performed. When linear polishers are utilized, they generally employ a flexible belt/pad assembly, so that a fluid platen can exploit this flexible property. The fluid flow from the fluid platen can compensate (or adjust) the pressure exerted by the polishing pad in engaging the wafer.

Likewise, this flexibility can be incorporated in a polishing head as well. By using a flexible diaphragm (or membrane) to couple the carrier to the head housing, the wafer carrier can be made to flex. One such polishing head utilizing a flexible diaphragm, although for a rotating table polisher, is disclosed in U.S. Pat. No. 5,205,082. The use of a flexible membrane allows the carrier to flex in the vertical direction. By ensuring a steady positive pressure on the carrier, a steady downforce can be maintained to engage the wafer on the pad.

A problem with using the known flexible membrane polishing head is that the flexibility, which improves the distribution of the downforce in the vertical direction, also introduces undesirable movement in other directions. Since there typically is a gap between the floating carrier and the sidewalls of the head housing assembly, there is a tendency for the carrier to move in the horizontal direction. This is especially pronounced with a linearly moving belt of a linear polisher. Since the belt/pad assembly always moves in the same horizontal direction, the horizontal force exerted on the wafer causes the carrier to move horizontally as well. Sometimes, the carrier will also pivot about an axis perpendicular to the horizontal axis, due to the horizontal force of the moving belt. The horizontal and/or the pivoting movement of the carrier can introduce uncertainties in the polishing performance, which can impact on the polishing uniformity. The polishing uniformity may not be compensated strictly from the averaging obtained by rotating the wafer. Thus, it is desirable to inhibit or reduce the flexible movement of the floating carrier in the horizontal direction, so that the center of the carrier will reside at the center of the head assembly during polishing.

The present invention describes a polishing head in which a floating (flexible) carrier is used, but one in which the horizontal travel of the carrier is restricted.

SUMMARY

According to one aspect of the present invention, a polishing head for performing chemical-mechanical polishing on a linear polisher is described, in which a flexible diaphragm coupling is used between a wafer carrier and a housing unit housing the wafer carrier. The flexible diaphragm is disposed across the carrier and the housing to permit the carrier and the wafer mounted thereon to move vertically, but restricts the carrier so that horizontal travel in the direction of a linearly moving belt is limited. A retainer ring for retaining the wafer on the carrier is affixed to the carrier itself so that it will not move independently from the carrier, in order to limit wafer slippage. The carrier is subjected to pressurized air or gas in order to maintain engagement of the wafer onto the pad.

In one embodiment, the carrier assembly is a singular unit but in an alternative embodiment, the carrier assembly incorporates a removable subcarrier. However, in both instances, the flexible diaphragm allows the wafer to move vertically, but the center shaft restricts horizontal movement of the wafer during polishing.

DETAILED DESCRIPTION OF THE PRESENTLY PREFERRED EMBODIMENTS

A novel polishing head to perform chemical-mechanical polishing (CMP) on a substrate is described. In the following description, numerous specific details are set forth, such as specific structures, materials, polishing techniques, etc., in order to provide a thorough understanding of the present invention. However, it will be appreciated by one skilled in the art that the present invention may be practiced without these specific details. In other instances, details of well known techniques and structures have been omitted for clarity in describing embodiments of the present invention. It is to be noted that a preferred embodiment of the present invention is described in reference to a linear polisher. However, it is readily understood that other types of polishers (including rotating table polishers) can be designed and implemented to practice the present invention without departing from the spirit and scope of the invention. Furthermore, although the present invention is described in reference to performing CMP on a semiconductor wafer, the invention can be readily adapted to polish other materials as well, including substrates for manufacturing flat panel displays.

Figure 1:
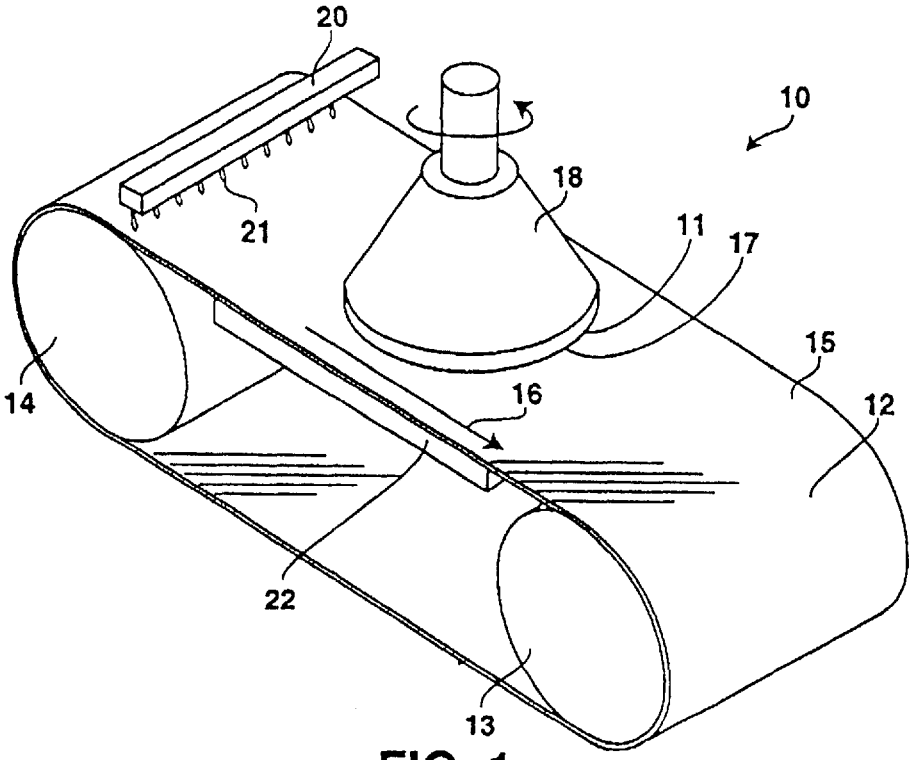
FIG. 1 Prior Art
FIG. 1 is a pictorial illustration of a prior art linear polisher for performing CMP.
Figure 2:
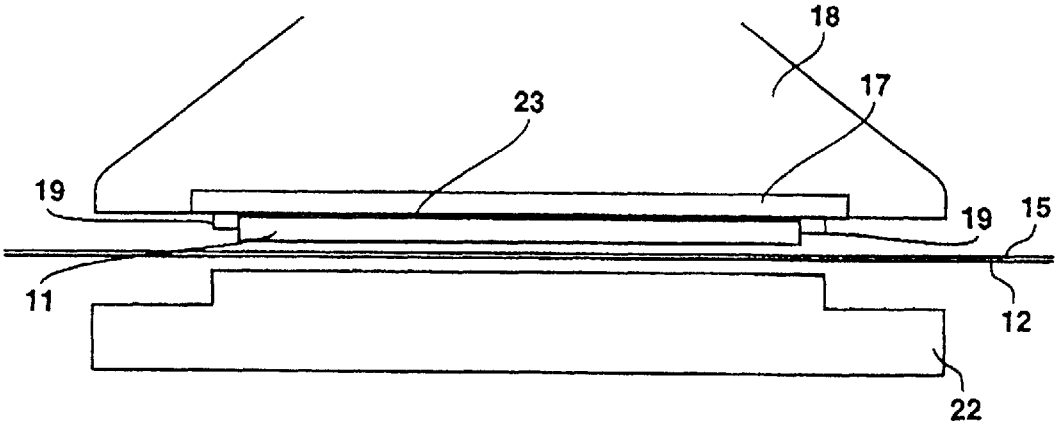
FIG. 2 Prior Art
FIG. 2 is a cross-sectional diagram of a portion of the linear polisher of FIG. 1.

Referring to FIG. 1, a linear polisher 10 for use in practicing the present invention is shown. FIG. 2 shows a cross-section of a portion of the polisher 10. The linear polisher 10 is utilized in polishing a semiconductor wafer 11, such as a silicon wafer, to polish away materials on the surface of the wafer. The material being removed can be the substrate material of the wafer itself or one of the layers formed on the substrate. Such formed layers include dielectric materials (such as silicon dioxide), metals (such as aluminum, copper or tungsten) and alloys, or semiconductor materials (such as silicon or polysilicon). More specifically, a polishing technique generally known in the art as chemical-mechanical polishing (CMP) is employed to polish one or more of these layers fabricated on the wafer 11, in order to planarize the surface. Generally, the art of performing CMP to polish away layers on a wafer is known and prevalent practice has been to perform CMP by subjecting the surface of the wafer to a rotating platform (or platen) containing a pad.

The linear polisher 10 utilizes a belt 12, which moves linearly in respect to the surface of the wafer 11. The belt 12 is a continuous belt rotating about rollers (or spindles) 13 and 14, in which one roller or both is/are driven by a driving means, such as a motor, so that the rotational motion of the rollers 13–14 causes the belt 12 to be driven in a linear motion (as shown by arrow 16) with respect to the wafer 11. A polishing pad 15 is affixed onto the belt 12 at its outer surface facing the wafer 11. Thus, the belt/pad assembly is made to move linearly to polish the wafer 11.

The wafer 11 typically resides on a wafer carrier 17, which is part of a polishing head assembly 18. The wafer 11 is held in position by a mechanical retaining means, such as a retainer ring 19, to prevent horizontal movement of the wafer when the wafer 11 is positioned to engage the pad 15. Generally, the head assembly 18 containing the wafer 11 is rotated, while the belt/pad moves in a linear direction 16 to polish the wafer 11. The linear polisher 10 also includes a slurry dispensing mechanism 20, which dispenses a slurry 21 onto the pad 15. A pad conditioner (not shown in the drawings) is typically used in order to recondition the pad 15 during use. Techniques for reconditioning the pad 15 during use are known in the art and generally require a constant scratching of the pad in order to remove the residue build-up caused by the used slurry and removed waste material.

A support or platen 22 is disposed on the underside of the belt 12 and opposite from carrier 17, such that the belt/pad assembly resides between the platen 22 and wafer 11 (which illustration is more clearly shown in FIG. 2). A primary purpose of the platen 22 is to provide a supporting platform on the underside of the belt 12 to ensure that the pad 15 makes sufficient contact with wafer 11 for uniform polishing. Typically, the carrier 17 is pressed downward against the belt 12 and pad 15 with appropriate force, so that the pad 15 makes sufficient contact with the wafer 11 for performing CMP. Since the belt 12 is flexible and will depress when the wafer is pressed downward onto the pad 15, the platen 22 provides a necessary counteracting support to this downward force (also referred to as downforce).

The platen 22 can be a solid platform or it can be a fluid platen (also referred to as a fluid bearing). The preference is to have a fluid platen, so that the fluid flow from the platen can be used to adjust forces exerted on the underside of the belt 12. By such fluid flow control, pressure variations exerted by the pad on the wafer can be adjusted to provide a more uniform polishing rate of the wafer surface. An example of a fluid platen is disclosed in U.S. Pat. No. 5,558,568.

Whether a solid platen or a fluid platen is used, the polishing head assembly 18 is a necessary element of the polisher 10. The head 18 includes the carrier 17, which is needed to hold and rotate the wafer 11. The wafer 11 rests on a seating pad or insert 23 and once positioned onto the carrier, the wafer 11 is held in position by the retainer ring 19 to prevent horizontal (sideways) movement. Some amount of downforce pressure is required to press the wafer 11 down onto the polishing pad 15. The same applies to both (linear and rotating) types of polishers and the amount of the downforce will depend on the particular polisher.

One type of carrier design employs a diaphragm (or membrane) to couple the carrier 17 to a housing body of the polishing head assembly 18. The flexible diaphragm permits the carrier to flex in the vertical direction, so that the carrier 17 and wafer 11 can move relative to the main body of the polishing head 18. Positive air pressure is introduced into the open interior area (cavity or chamber) of the support housing above the carrier 17 so that the carrier is forced to engage the polishing pad 15 with adequate downforce.

Due to the flexibility of the diaphragm, polishing heads employing the diaphragm coupled wafer carrier are desirable for polishing wafers (as well as other materials or substrates) on a linear polisher. When the carrier moves the wafer in the lateral (horizontal) direction, such movement can degrade the polishing uniformity. Accordingly, the present invention describes a novel polishing head, which utilizes a flexible coupling means, such as a diaphragm or a membrane, to couple the carrier to the polishing head housing, but in which the horizontal movement of the carrier is restricted.

Figure 3:
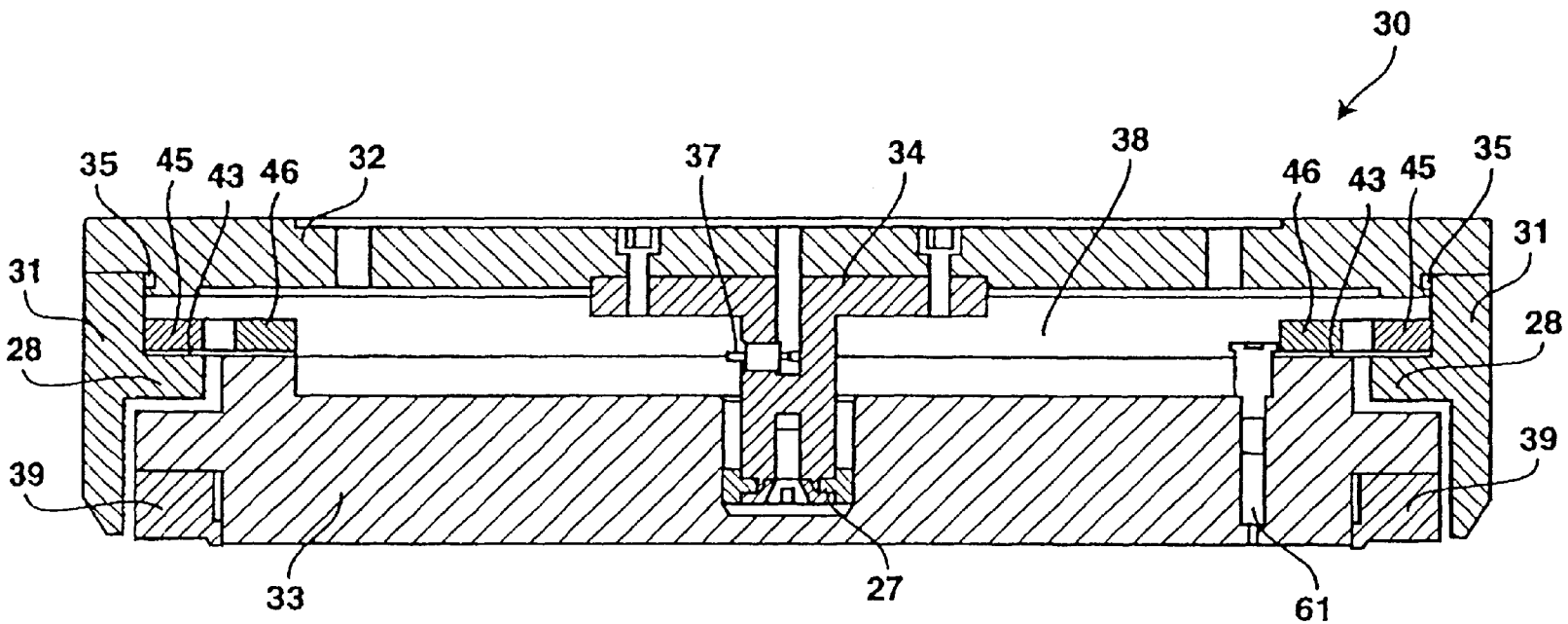
FIG. 3 is a cross-sectional view of a polishing head according to a preferred embodiment.

In FIG. 3, a cross-sectional view of a polishing head 30 of the preferred embodiment is shown. When employed with a linear polisher (such as the linear polisher 10 of FIG. 1), the polishing head 30 is utilized in place of the polishing head 18. The polishing head 30 is comprised of a head housing (also referred to as a support housing) 31, cover 32, carrier assembly (or simply referred to as a carrier) 33 and a central member 34. In the preferred embodiment, the center member is a shaft or a post, which is also referred to as a shaft flange assembly. The head or support housing 31 is circular in shape and forms the outer support body for the polishing head 30. The cover 32 is affixed to the upper end of the housing 31 to enclose the interior center region of the housing 31. An O-ring 35 is utilized to ensure that a tight seal is formed when the cover 32 is positioned onto the support housing 31.

At the opposite end from the cover 32, the head housing 31 forms a circular opening into which the carrier 33 is inserted. The carrier 33 is coupled to the support housing 31 by a flexible couple means. In the preferred embodiment, a diaphragm (or flexible membrane) 43 is utilized. The diaphragm 43 is stretched across and mounted onto a base surface of the housing 31 and to an upper surface of the carrier 33. In the preferred embodiment, two circular retaining rings 45 and 46 are utilized, one at each end of the diaphragm 43 to retain it in place. The retaining rings 45 and 46 are affixed tightly onto the two units by a mounting means, such as screws or bolts. With the placement of the carrier 33 in position within the support housing 31 and with proper seal integrity, the interior open region forms a pressure chamber 38.

At the lower end of the carrier 33, a wafer retainer ring 39 is affixed to the carrier 33 to prevent horizontal movement of the wafer, when the wafer is positioned on the carrier 33. The retainer ring 39 is mounted on the carrier 33 by means, such as bolts and screws. Since the retainer ring is affixed to the carrier 33, it moves in unison with the carrier 33. Also, typically, there is an insert (padding) placed at the bottom surface of the carrier 33, in order to cushion the wafer when the wafer is mounted onto the carrier 33.

The shaft 34 is affixed to the cover at one end and the other end is made to extend into a recessed region 53, which is centrally located on the carrier 33 along the surface facing the chamber 38. Mounting means, such as screws or bolts, are used to affix the proximal end of shaft 34 to the cover 32. The carrier (or distal) end of the shaft 34 is made to fit into the recessed region 53. The distal end is slideably coupled to the carrier 33 so that the carrier 33 can move vertically relative to the central shaft 34. In the embodiment shown in FIG. 3, a bushing 27 is disposed at the distal end of the shaft 34 to ensure a snug fit, but the carrier 33 is still free to move relative to the shaft 34.

When the head assembly 30 is installed in a polishing tool, the cover 32 is coupled to an adapter on a spindle (not shown). When the spindle is driven to rotate, the complete head assembly rotates as well. The necessary fluid and/or vacuum feed lines for the head 30 are routed through the spindle into the shaft 34, which then distributes the fluid/vacuum throughout the head assembly.

In operation, pressurized fluid (preferably air or gas) is then introduced into the main chamber 38 through a port opening 37 located on the shaft 34, so that there is positive pressure in the chamber 38. This pressure can be adjusted during use, if desired. Positive pressure in the chamber 38 ensures that a steady downward pressure is exerted when the wafer 11 engages the belt/pad assembly. By having the chamber 38 at a higher pressure than the ambient (the pressure outside of the polishing head), the carrier 33 can be forced downward against the pad during polishing and in which, the amount of the downforce can be adjusted by varying the pressure in the main chamber 38. It is also appreciated that during polishing, an upward force from the belt region can cause the carrier 33 to be pushed upward with some amount of force. The pressure in the main chamber 38 ensures that a steady downforce is exerted to engage the wafer on the pad, even when this upward (or counter-acting) force is present.

As described above, the carrier 33 is coupled to the support housing 31 by the diaphragm 43, so that the carrier 33 can move vertically relative to the housing 31. That is, the two housing surfaces are coupled together by the diaphragm 43 and move vertically relative to each other. The outer sides of the carrier 33 aligns to the interior sidewall of the housing 31, but a slight gap exists between the two surfaces to permit movement of the carrier 33.

Thus, as the spindle is driven on the polishing tool, the cover 32 is made to rotate, causing the complete head assembly 30 to rotate. Due to the flexible coupling of the diaphragm 43, the carrier 33 is capable of moving in the vertical direction. However, the upward travel of the carrier 33 is limited by the presence of a ridged mechanical stop 28 on the interior surface of the support housing 31. Thus, the carrier 33 (and the wafer residing thereon) is made to float, allowing a wafer to be polished with less variation in the polishing uniformity profile.

An improved feature of the head 30 of the present invention is the use of the center shaft 34. The presence of the center shaft restricts the horizontal movement of the carrier and, thus, the wafer during polishing. Unlike the rotating pad polishers, a linear polisher has its pad motion in a distinct linear direction. This movement places significant linear transitional force on the wafer during polishing, so that without some form of horizontal restriction, the floating carrier will have a tendency to be displaced in the horizontal direction. That is, the center vertical axes of the support housing may not be in line with that of the wafer, which can impact the desired polishing profile and polishing uniformity. The center shaft restricts the horizontal movement of the wafer carrier. Because the horizontal movement of the wafer is restricted, it will not move appreciably in the horizontal (linear) direction when the linear force is exerted by the moving belt/pad. Also, with a properly restricting shaft assembly, the rotational force on the carrier caused by the linear motion can also be reduced or restricted altogether, if desired.

Furthermore, a separate fluid line (of which a portion is shown in FIG. 3) is used to couple vacuum to and through the carrier 33. A plurality of channels 61 are formed through the carrier 33 to couple fluid/vacuum to openings formed at the wafer receiving surface of the carrier 33. The channels 61 are used to convey vacuum pressure to the wafer receiving surface of the carrier 33, so that once the wafer is placed on this surface, the vacuum will retain the wafer thereon. In an alternative embodiment, channels 61 (or a separate equivalent line) has fluid (liquid in the preferred embodiment) flow as well to dislodge the wafer from the surface of the carrier 33. In the preferred embodiment, vacuum is coupled to the channels 61 to hold the wafer against the carrier 33 and later, water is made to flow through the channels 61 in order to safely break the adhesive bond between the wafer and the carrier 33 to dislodge the wafer from the carrier 33.

Figure 4:
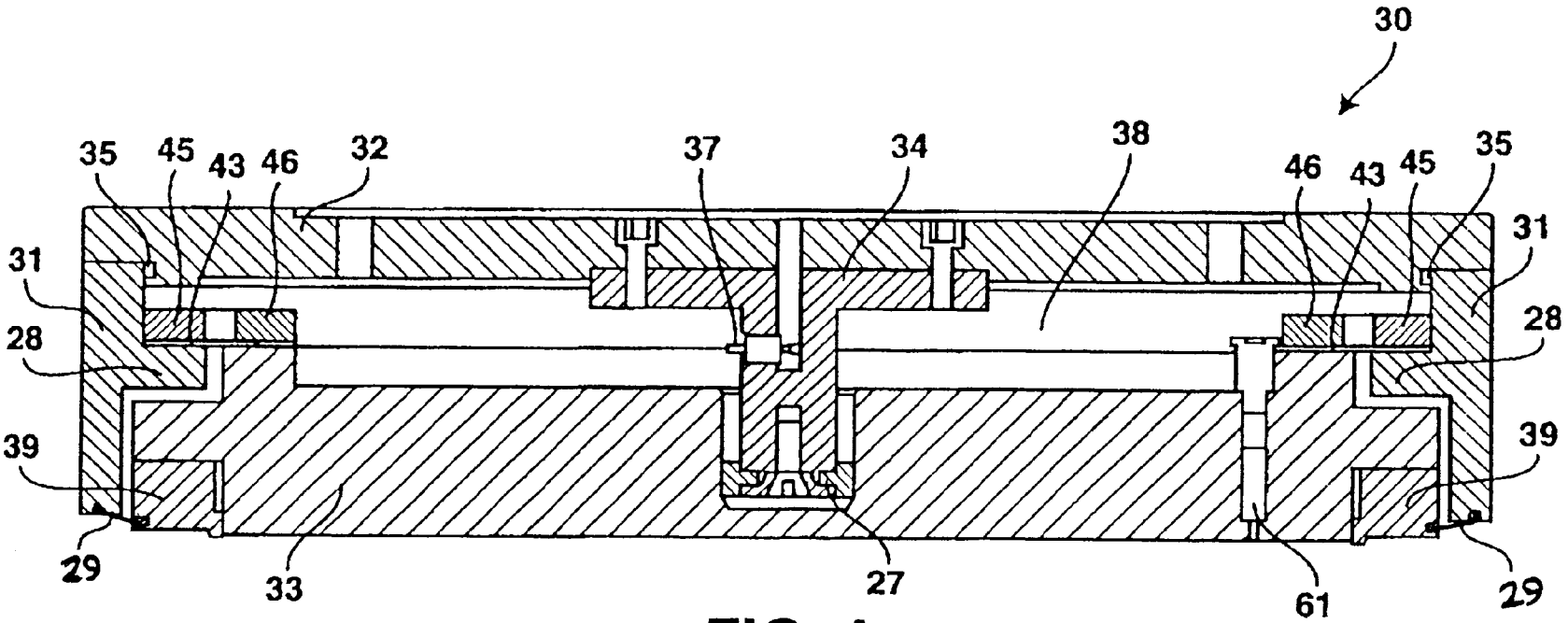
FIG. 4 shows the polishing head of FIG. 3, but also implementing a splash diaphragm to prevent slurry seepage into polishing head.

FIG. 4 shows an addition of a feature to the polishing head 30 of FIG. 3. In FIG. 4, the polishing head 30 incorporates the use of a splash diaphragm 29. The splash diaphragm 29 is a flexible membrane, similar to the diaphragm 43. The diaphragm 29 is attached at one end to the wafer retainer ring 39 and the other end to the support housing 31. In the preferred embodiment shown, the diaphragm 29 is attached to a slit along the outer sidewall of the retainer ring 39 and affixed to the support housing by a retainer. Other methods of attaching the diaphragm may also be used.

The slurry present on the pad can readily move up into the gap between the retainer ring 39 and the housing 31 and such slurry accumulation can contribute to the misalignment of the carrier 33. The splash diaphragm 29 is utilized to prevent such slurry flow into the gap region between the retainer ring 39 and the support housing 31, so that the desired polishing profiles are not undesirable altered by such slurry accumulation.

Thus, a novel polishing head for use with a linear polisher to perform CMP on a semiconductor wafer is described. However, it is appreciated that the polishing head could be readily adapted for polishing other materials as well, such as other substrates, including substrates for fabricating flat panel displays. Furthermore, although the polishing head was designed for the purpose of using it on a linear polisher, it could be readily designed to be configured for use on a rotating (orbital) polisher. It is also appreciated that affixing the wafer retainer as part of the carrier housing in a flexible membrane (diaphragm) coupled polishing head, allows for the wafer retainer and the wafer to move in unison to reduce or prevent wafer slippage within the carrier during polishing.

An alternative embodiment for practicing the present invention is described below. In the alternative technique, a polishing head employing a removable subcarrier is described. The removable subcarrier is described in the aforementioned parent application. Accordingly, same reference numerals are utilized herein to describe the like kind features of the polishing heads.

Figure 5:
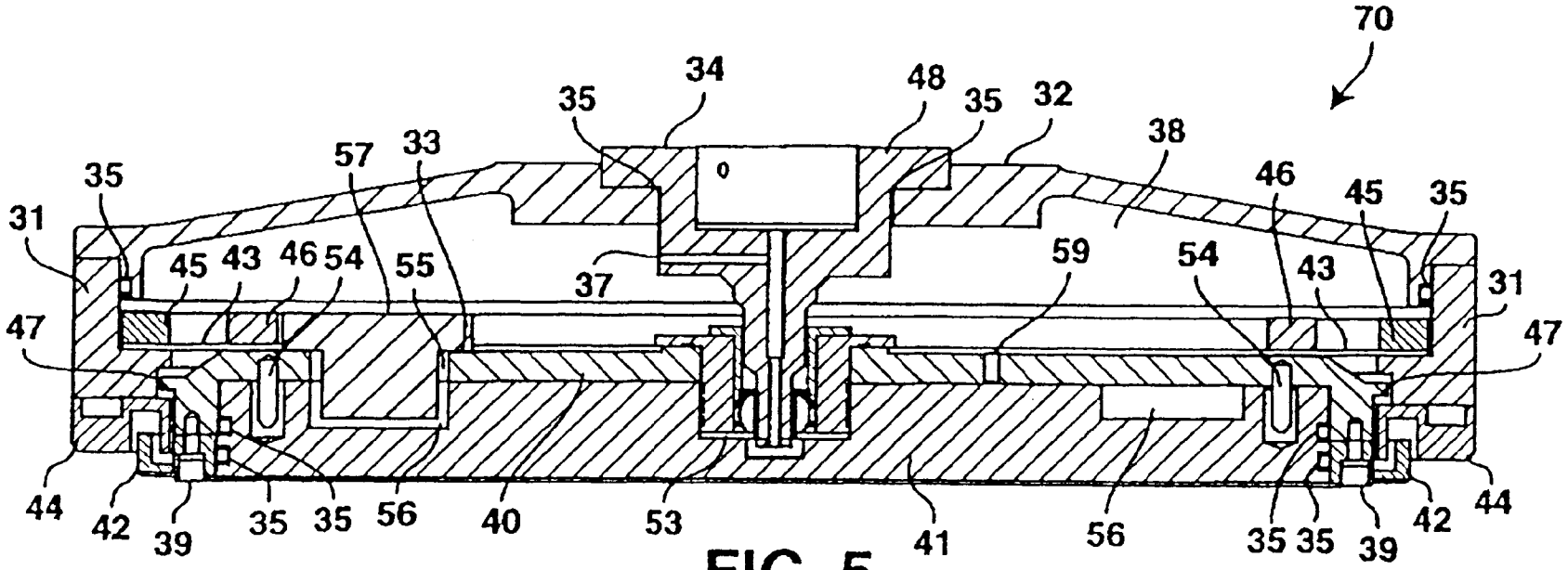
FIG. 5 is a cross-sectional view of an embodiment of an alternative polishing head in which a removable subcarrier is used.
Figure 6:
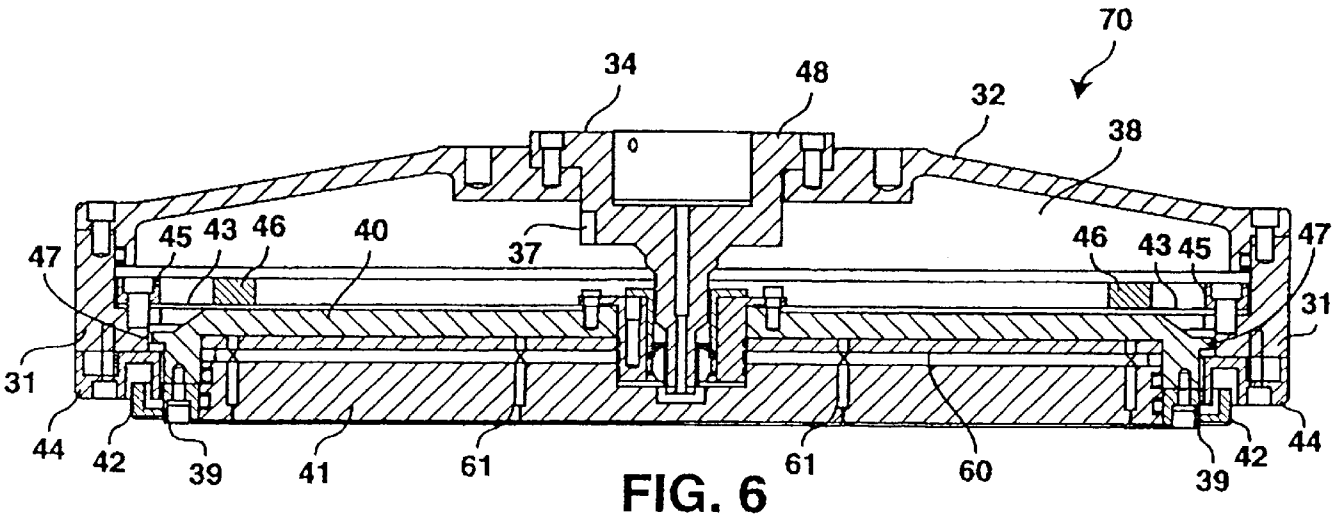
FIG. 6 is a cross-sectional view of the polishing head of FIG. 5, but taken across a different cross-sectional axis.
Figure 7:
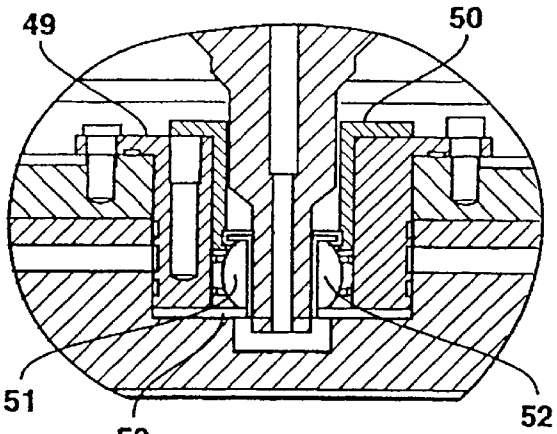
FIG. 7 is an enlarged cross-sectional view of a center portion of the polishing head as shown in FIG. 6.

In FIG. 5, a cross-sectional view of a polishing head 70 of an alternative embodiment is shown. A second cross-sectional view of the polishing head 70, taken across another axis, is shown in FIG. 6. An enlargement of the center shaft section is shown in FIG. 7. Accordingly, the description below should be read in reference to FIGS. 5, 6 and 7.

The polishing head 70 is comprised of an equivalent head or support housing 31, cover 32, carrier 33 and center shaft (or flange) assembly 34. Unlike the earlier described polishing head 30, the carrier assembly 33 of the alternative embodiment is comprised of two separate stages, identified as a carrier housing (also referred to as a subcarrier housing, since it is coupled to house a subcarrier) 40 and a removable subcarrier 41. The head or support housing 31 is still circular in shape and forms the outer support body for the polishing head 30. The cover 32 has a central opening into which the shaft assembly 34 is inserted. The cover 32 is affixed to the upper end of the housing 31 to enclose the interior center region of the housing 31 to form chamber 38, when the shaft assembly 34 is also in place.

At the opposite end from the cover 32, the support housing 31 forms a circular opening into which the carrier assembly 33 is disposed. The subcarrier housing 40 is coupled to the support housing 31 by a flexible coupling means, such as the aforementioned diaphragm (or flexible membrane) 43. The diaphragm 43 is stretched across and mounted onto a base surface of the housing 31 and an upper surface of the subcarrier housing 40. Again, two circular retaining rings 45 and 46 are utilized, one at each end of the diaphragm 43 to retain it in place across the two housings.

When in operation, pressurized fluid (preferably air or gas) is then introduced into the main chamber 38 through a port opening 37 of a fluid line in the shaft assembly 34, so that the pressure in the chamber 38 can be adjusted. Positive pressure in the chamber 38 ensures that a steady downward pressure is exerted when the wafer 11 engages the belt/pad assembly. By having the chamber 38 at a higher pressure than the ambient (the pressure outside of the polishing head), the carrier assembly 33 can be forced downward against the pad during polishing and in which, the amount of the downforce can be adjusted by varying the pressure in the main chamber 38.

As described above, the carrier assembly 33 is comprised of the subcarrier housing 40 and the subcarrier 41. The subcarrier housing 40 forms the floor of the main chamber 38. The sidewalls of the subcarrier housing 40 aligns to the interior side of the support housing 31, but again a slight gap exists between the two surfaces, which allows the subcarrier housing 40 to move vertically relative to the head housing 31 as the diaphragm 43 flexes.

At the lower end of the subcarrier housing 40, the retainer ring 39 is affixed to the subcarrier housing 40 to prevent horizontal movement of the wafer, when the wafer is positioned in place. In this embodiment, the retainer ring 39 has an L-shaped projection 42 which projects outwardly, then upwardly from the subcarrier housing 40. The upward bend of the projection 42 enters a recessed opening of a lower flange 44, located at the lower surface of the head housing 31. Also, as shown in the drawings at various locations, a number of O-rings 35 are distributed throughout the head 30 to provide a seal where various components of the head mate. The O-rings 35 also ensure to provide a pressure seal for the main chamber 38, as well as for a secondary chamber described below.

The shaft assembly 34 is inserted through a central opening in the cover 32 and the subcarrier housing 40, and the distal end of the shaft assembly 34 extends through the central opening of the subcarrier housing 40. The shaft assembly 34 is comprised of a shaft 48, which has a wider diameter at the cover end versus a narrower diameter at the distal (or subcarrier) end. The upper end of the shaft 48 is affixed to the cover 32, while the distal end is made to fit into a bearing housing 49.

The shaft assembly 34 includes a number of components at the subcarrier end to ensure that the shaft 48 fits properly into the central open region of the subcarrier housing 40. As shown in detail in FIG. 7, the bearing housing 49 is disposed within the central opening of the subcarrier housing 40 and affixed to it by mounting means (such as bolts and screws). A clamp bearing 50 is disposed within the bearing housing 49 to ensure a snug fit of the shaft 48. A spherical bearing 51 and a linear slide bearing 52 are disposed at the tip region of the shaft 48 as well. The slide bearing 42 allows vertical movement of the carrier assembly 33 relative to the shaft 48. The spherical bearing 51 allows some degree of angular (rotational) freedom for the lower subcarrier 41, if such motion is desired. However, it can be removed to prevent any such angular movement. As shown in the Figures, the slide bearing 52 is press fitted into the spherical bearing 51 and the spherical bearing 51 is clamped in place by the clamp bearing 50.

Thus, as the spindle is driven, the cover 32 is made to rotate, causing the complete head assembly 70 to rotate. Due to the flexible coupling of the diaphragm 43, the subcarrier housing 40 is capable of moving in the vertical direction. However, the vertical travel of the subcarrier housing 40 relative to the head housing 31 is limited by the presence of ridged mechanical stops. The L-shaped projection 42 provides for a limit in the upward vertical travel of the subcarrier housing 40 and ringed extension 47 of the subcarrier housing 40 provides for a limit in the downward travel direction.

An improved feature of the head 70 is the use of a subcarrier 41, which is removable. As shown in the Figures, the subcarrier 41 is a separate element from the subcarrier housing 40. The subcarrier 41 is made to fit onto the subcarrier housing 40 and within the circular boundary of the housing 31. The lower surface of the subcarrier 41 is substantially flat so that the wafer 11 can be mounted thereon. Guide pins 54, located on the subcarrier housing 40, assist in positioning the subcarrier 41 for coupling it to the subcarrier housing 40. That is, the guide pins 54 are used to guide the two units 40 and 41 as they are being mated together. The subcarrier 41 has a central recessed region 53 for receiving the shaft assembly 34, including the distal end of the shaft 48. The alignment of the two units 40 and 41 is achieved by having the bearing housing 49 fully seated in the recess 53.

At this point, the subcarrier 41 is positioned against the subcarrier housing 40 and is restricted or limited in its movement in the vertical and horizontal directions. However, final alignment of the subcarrier 41 to the subcarrier housing 40 is achieved when a flange key is inserted as noted below. At least one recessed slot 56 (two are shown in FIG. 5), located proximal to the outer edge, is needed to couple a flange key 57, which operates as a torque transfer coupler. The key 57 is used to transfer torque from the subcarrier housing 40 to the subcarrier 41. The key 57 is inserted through a key opening 55 in the subcarrier housing 40 and made to extend into one of the mating slots 56 of the subcarrier 41. The key is mounted onto the subcarrier housing 40 by screws, bolts or other mounting means. A purpose of the key 57 is to transfer the torque from the driven subcarrier housing 40 to the subcarrier 41, so that the subcarrier 41 will rotate when the head 30 is driven. It is appreciated that other torque transfer couplers can be used in place of the key 57 to transfer the torque.

When the subcarrier 41 is inserted in position onto the subcarrier housing 40, the opening 55 mates to one of the slots 56 containing the key 57. However, even though the two units 40 and 41 are aligned into position, the subcarrier 41 is not affixed onto the subcarrier housing 40 by mounting means, such as bolts or screws. The subcarrier 41 is made removable or detachable from the subcarrier housing 40 and the head assembly 30.

The preferred technique is to utilize vacuum to hold the two units 40 and 41 together. That is, vacuum feed to the carrier housing surface which mates to the subcarrier 41, ensures that the subcarrier 41 will not separate from the subcarrier housing 40. As a further assurance, in the preferred embodiment, O-rings 35 disposed around the periphery of the subcarrier 41, provide for a friction fit between the two units 40 and 41. Since at least one O-ring (or an equivalent sealing device) is needed for sealing a pressure chamber, the presence of the O-ring(s) will also provide a friction fit of the two units 40 and 41. This friction fit will retain the subcarrier 41 against the subcarrier housing 40 once installed. Thus, if the head assembly 70 is lifted, the subcarrier 41 will not drop out of the head assembly 70, even if the vacuum is removed. However, the preferred technique is to have the vacuum present.

When the subcarrier 41 is in position, a secondary pressure chamber 60 forms between the lower surface of the subcarrier housing 40 and the upper surface of the subcarrier 41. One or more O-ring(s) 35 along the side of the subcarrier 41 ensure a tight fit between the subcarrier 41 and the subcarrier housing 40 along the vertical interface in order to form a tight seal for the chamber 60. A separate fluid line having a port opening 59 is coupled to the secondary chamber 60 to introduce pressurized fluid (preferably air or gas) between the subcarrier housing 40 and the subcarrier 41. A purpose of this secondary pressure chamber 60 will be described below.

Additionally, a third fluid line and the plurality of channels 61 are used to couple vacuum to and through the subcarrier 41. The channels 61 formed through the subcarrier 41 couple the vacuum line from the subcarrier housing 40 to openings formed at the wafer receiving surface of the subcarrier 41. The channels 61 convey vacuum pressure to the wafer receiving surface of the subcarrier 41, so that once the wafer is placed on this surface, the vacuum will retain the wafer thereon. The channels 61 (or a separate equivalent line) can also have fluid flow (water in the preferred technique) to dislodge the wafer from the surface of the subcarrier 41. Thus, vacuum is coupled to the channels 61 to hold the wafer against the subcarrier 41 and later, water flow to the channels 61 is used to safely break the adhesive bond between the wafer and the subcarrier 41.

In operation, when the polishing head 70 of the present invention is to be utilized for performing CMP on a substrate material, such as a silicon semiconductor wafer, the head assembly is brought into position above the belt assembly, minus the subcarrier 41. The subcarrier 41 is aligned to the key 57 to position the subcarrier 41 within the head assembly. At this point, the subcarrier 41 is friction fitted and installed onto the subcarrier housing 40. Once installed, the subcarrier 41 is safely maintained in its position by the use of vacuum.

The preferred technique is to couple the second fluid line to vacuum (or near vacuum pressure) so that a pressure less than ambient (negative pressure) is present at the port opening 59. This negative pressure is introduced into the secondary chamber 60, in order to ensure that the subcarrier 41 is maintained in the up (or installed) position relative to the subcarrier housing 40. It is appreciated that other retaining techniques can be used as well to hold the subcarrier 41 in position against the subcarrier housing 40, but the preferred technique is to use vacuum. It is to be noted that the O-rings friction fit the subcarrier 41 to retain it in place against the subcarrier housing 40. However, it is more desirable to apply the vacuum, in order to ensure that the subcarrier 41 will stay in the installed position. It is also appreciated that in some alternative designs, there may be frictionless fit between the subcarrier 41 and the subcarrier housing 40. In that instance, the application of vacuum will ensure that the two units will be held together.

Subsequently, the wafer is loaded onto the subcarrier 41. The preferred technique couples vacuum to the channels 61, so that this vacuum will retain the wafer against the subcarrier surface. The retainer ring 39 ensures that the wafer will not slip in the horizontal direction. It is also preferred at this stage to have the main chamber 38 under some positive pressure, so that the subcarrier housing 40 is forced downward, making the subcarrier 41 insertion easier. Once the subcarrier 41 is loaded onto the subcarrier housing 40 and the wafer is loaded onto the subcarrier 41, the head 70 is lowered to engage the polishing belt to perform CMP.

Once the head has engaged the pad, positive pressure is increased in the main chamber 38. The increased positive pressure in the main chamber 38 ensures that adequate downforce is exerted to keep the wafer pressed onto the pad. At this point, vacuum for holding the wafer is removed. Since the wafer is now pressed onto the pad, vacuum is not needed. The main chamber 38 should be at the operating pressure. If not, then the main chamber pressure is brought to its operating pressure.

At this point, the subcarrier 41 rests against the subcarrier housing 40. Then, the vacuum is removed from the secondary chamber 60 and the pressure to the secondary chamber 60 is raised up to its operating pressure. Typically, the pressure in the secondary chamber 60 is maintained slightly lower than the pressure in the main chamber 38. For example, if the main chamber 38 has an operating pressure set at 5 p.s.i., then the secondary chamber 60 is maintained at a pressure of approximately 4.5 p.s.i. This ensures that there is slightly more downforce exerted on the subcarrier housing 40, so that the subcarrier 41 will not separate from the subcarrier housing 40.

Since there is a separate pressure chamber residing directly above the subcarrier 41, this secondary chamber 60 ensures a direct distribution of the pressure onto the subcarrier itself. Also, since the fluid to the secondary chamber 60 is independently controlled from the fluid flow into the main chamber 38, variations in the pressure (or variations in the pressure distribution) of the main chamber will have less of an effect on the downforce exerted on the wafer. By having this separate pressure chamber 60, a more confining region between the subcarrier housing 40 and the subcarrier 41 is defined for the distribution of the final pressure stage for exerting the downforce. Thus, a more uniform downforce can be exerted in pressing the wafer onto the pad surface. That is, the downforce exerted onto the wafer is distributed directly and more uniformly, than if that force were applied only within the main chamber 38. Thus, a more uniform polishing of the wafer can be achieved, due to a more uniform and direct pressure distribution on the subcarrier 41.

As stated earlier, during the polishing process, vacuum is not present in the third fluid line. As the head 30 is rotated, the subcarrier 40 rotates with the head assembly. The key 57 couples the rotating motion of the subcarrier housing 40 to the subcarrier 41 in order to rotate the subcarrier 41. Thus, the torque transfer is achieved by the key 57.

Subsequently, once the polishing is completed, the secondary chamber 60 pressure is lowered and vacuum is introduced to hold the subcarrier 41 against the subcarrier housing 40. Vacuum is also introduced in the channels 61 to hold the wafer against the subcarrier 41, so as to ensure a secure hold on the wafer when the head 70 is lifted from the belt/pad assembly. The pressure in the main chamber 38 is lowered and the head assembly is lifted from the pad. Fluid (in the form of water for the preferred embodiment) is introduced into the channels 61 to gently break the bond between the wafer and the lower surface of the subcarrier 41. Subsequently, the next wafer for polishing is loaded into the subcarrier 41.

Aside from the advantages noted above, the removable nature of the subcarrier also has further advantages, as noted below. Since the subcarrier 41 is not attached as part of the carrier or subcarrier housing 40, it can be readily removed. Furthermore, since only the subcarrier 41 is removed (and not the complete head assembly) the weight of the assembly being handled during removal is significantly lighter, making the removal process much easier. Additionally, since the subcarrier 41 can be easily removed, it can be cleaned more rapidly and the wafer insert or pad material (which resides between the wafer and the subcarrier 41) can be replaced more easily as well.

Another advantage is in the area of process or manufacturing repeatability. Repeatability, as defined, is the ability to obtain the same parameters (or results), each time a process is performed on a tool. Thus, with prior art polishing heads, the complete head assembly is removed to service the wafer carrier for many routine maintenance procedures. In some instances disassembly is required. When the polishing head is then placed back in service, it may not retain the same performance characteristics, which then will require adjustments to repeat the desired performance. Although there may be instances where a complete head removal may be necessary with the wafer carrier described herein, a number of routine maintenance procedures will only require the subcarrier to be removed. Removing only the subcarrier will reduce (or eliminate) the need for adjustments when the subcarrier is placed into service. Accordingly, having the removable subcarrier improves the repeatability of the polishing head and the tool to which it is mounted on.

It is appreciated that the polishing head 70 of the alternative embodiment can employ the splash diaphragm as well to prevent slurry accumulation, as was done with the polishing head 30.

Thus, a polishing head having a floating carrier and a center shaft assembly is described. The floating carrier allows for movement in the vertical direction, but the center shaft restricts horizontal movement of the wafer. The invention is described being implemented in a more standard carrier assembly and also in a carrier assembly having a removable subcarrier.

We claim:

1. A polishing head for polishing a surface of a material mounted thereon by engaging said material surface against a polishing pad comprising:

a support housing;

a carrier for mounting said material thereon;

a flexible coupler for coupling said carrier to said support housing in order to permit said carrier to move relative to said support housing;

a central member affixed to said support housing and slideably coupled to said carrier for permitting vertical movement of said carrier relative to said housing, but restricting horizontal movement of said carrier, whereby a first end of said central member extends into a recessed region disposed on said carrier, said first end in continual, movable contact within said recessed region with said carrier.

2. The polishing head of claim 1 wherein said carrier is subjected to pressurized air or gas in order to provide a downforce to maintain engagement of said material surface onto said polishing pad.

3. The polishing head of claim 2 further including a retainer affixed to said carrier for retaining said material on said carrier and restricting movement of said material retained, said retainer moving in unison with said carrier.

4. The polishing head of claim 3 wherein said support housing includes a cover and said central member is located centrally attached to said cover at a second end.

5. The polishing head of claim 3 wherein said flexible coupler is a flexible membrane.

6. The polishing pad of claim 5 wherein said flexible membrane is a rubber membrane.

7. The polishing head of claim 3 further including a splash diaphragm coupled to said retainer and said support housing in order to cover a gap between said retainer and said support housing, said gap being adjacent to said polishing pad.

8. A polishing head for polishing a semiconductor wafer mounted thereon by engaging a front surface of said wafer against a polishing pad comprising:

a support housing;

a carrier for mounting said wafer thereon by having a back surface of said wafer disposed against a wafer-mounting surface of said carrier;

a flexible diaphragm for coupling said carrier to said support housing in order to permit said carrier to move relative to said support housing;

a central shaft affixed to said support housing and slideable coupled to said carrier for permitting vertical movement of said carrier relative to said housing, but restricting horizontal movement of said carrier, wherein a first end of said central shaft extends into a recessed region disposed on said carrier and is in continual, movable contact within said recessed region with said carrier.

9. The polishing head of claim 8 wherein said carrier is inserted into a cavity formed in said support housing and said cavity is subjected to pressurized air or gas in order to provide a force to maintain engagement of said wafer onto said polishing pad.

10. The polishing head of claim 9 further including a retainer ring affixed along a periphery of said wafer-mounting surface of said carrier for retaining said wafer against said wafer-mounting surface and restricting movement of said wafer relative to said carrier, said retainer ring moving in unison with said carrier.

11. The polishing head of claim 10 wherein said central shaft is a rigid shaft coupled to a covering of said support housing at a second end and wherein said first end includes a slideable coupling for permitting said carrier to move vertically relative to said central shaft.

12. The polishing head of claim 11 wherein said slideable coupling is a bushing.

13. The polishing head of claim 11 wherein said slideable coupling is a bearing.

14. The polishing head of claim 11 further including a splash diaphragm coupled to said retainer ring and said support housing in order to cover a gap between said retainer ring and said support housing, said gap being adjacent to said polishing pad.

15. A polishing head for performing chemical-mechanical polishing on a semiconductor wafer mounted thereon by engaging a front surface of said wafer against a polishing pad disposed on a linearly moving belt comprising:

a support housing;

a carrier for mounting said wafer thereon by having a back surface of said wafer disposed against a wafer-mounting surface of said carrier;

a flexible diaphragm for coupling said carrier to said support housing in order to permit said carrier to move relative to said support housing;

a central rigid shaft affixed to said support housing and slideable coupled to said carrier for permitting vertical movement of said carrier relative to said support housing, but restricting horizontal movement of said carrier, wherein a first end of said central rigid shaft extends into a recessed region disposed on said carrier and is in continual, movable contact within said recessed region with said carrier.

16. The polishing head of claim 15 wherein said carrier is inserted into a cavity formed in said support housing and said cavity is subjected to pressurized air or gas in order to provide a force to maintain engagement of said wafer onto said polishing pad.

17. The polishing head of claim 16 further including a retainer ring affixed along a periphery of said wafer-mounting surface of said carrier for retaining said wafer against said wafer-mounting surface and restricting movement of said wafer relative to said carrier, said retainer ring moving in unison with said carrier.

18. The polishing head of claim 17 wherein said central shaft is coupled to a covering of said support housing at a second end and wherein said first end includes a slideable coupling for permitting said carrier to move vertically relative to said central shaft.

19. The polishing head of claim 18 wherein said slideable coupling is a bushing.

20. The polishing head of claim 18 wherein said slideable coupling is a bearing.

21. The polishing head of claim 18 further including a splash diaphragm coupled to said retainer ring and said support housing in order to cover a gap between said retainer ring and said support housing, said gap being adjacent to said polishing pad.

22. A polishing head for polishing a surface of a material mounted thereon by engaging said material surface against a polishing pad comprising:

a support housing;

a carrier for mounting said material thereon, Wherein said carrier is subjected to pressurized air or gas in order to provide a downforce to maintain engagement of said material surface onto said polishing pad;

a retainer affixed to said carrier for retaining said material on said carrier and restricting movement of said material retained, said retainer moving in unison with said carrier;

a flexible coupler or coupling said carrier to said support housing in order to permit said carrier to move relative to said support housing; and a central member affixed to said support housing and slideably coupled to said carrier for permitting vertical movement of said carrier relative to said housing, but restricting horizontal movement of said carrier, wherein said support housing includes a cover and said central member is located centrally attached to said cover at one end and the other end is extended into a recessed region disposed on said carrier.

23. A polishing head for polishing a surface of a material mounted thereon by engaging said material surface against a polishing pad comprising:

a support housing;

a carrier for mounting said material thereon, wherein said carrier is subjected to pressurized air or gas in order to provide a downforce to maintain engagement of said material surface onto said polishing pad;

a retainer affixed to said carrier for retaining said material on said carrier and restricting movement of said material retained, said retainer moving in unison with said carrier;

a flexible coupler for coupling said carrier to said support housing in order to permit said carrier to move relative to said support housing;

a central member affixed to said support housing and slideably coupled to said carrier for permitting vertical movement of said carrier relative to said housing, but restricting horizontal movement of said carrier; and a splash diaphragm coupled to said retainer and said support housing in order to cover a gap between said retainer and said support housing, said gap being adjacent to said polishing pad.

24. A polishing head for polishing a semiconductor wafer mounted thereon by engaging a front surface of said wafer against a polishing pad comprising:

a support housing;

a carrier for mounting said wafer thereon by having a back surface of said wafer disposed against a wafer-mounting surface of said carrier, wherein said carrier is inserted into a cavity formed in said support housing and said cavity is subjected to pressurized air or gas in order to provide a force to maintain engagement of said wafer onto said polishing pad;

a retainer ring affixed along a periphery of said wafer-mounting surface of said carrier for retaining said wafer against said wafer-mounting surface and restricting movement of said wafer relative to said carrier, said retainer ring moving in unison with said carrier;

a flexible diaphragm for coupling said carrier to said support housing in order to permit said carrier to move relative to said support housing;

a central shaft affixed to said support housing and slideable coupled to said carrier for permitting vertical movement of said carrier relative to said housing, but restricting horizontal movement of said carrier, wherein said central shaft is a rigid shaft coupled to a covering of said support housing at one end and the other end is extended into a recessed region disposed on said carrier, wherein said end extended into said recessed region includes a slideable coupling for permitting said carrier to move vertically to said central shaft.

25. The polishing head of claim 24 wherein said slideable coupling is a bushing.

26. The polishing head of claim 24 wherein said slideable coupling is a bearing.

27. The polishing head of claim 24 further including a splash diaphragm coupled to said retainer ring and said support housing in order to cover a gap between said retainer ring and said support housing, said gap being adjacent to said polishing pad.

28. A polishing head for performing chemical-mechanical polishing on a semiconductor wafer mounted thereon by engaging a front surface of said wafer against a polishing pad disposed on a linearly moving belt comprising:

a support housing;

a carrier for mounting said wafer thereon by having a back surface of said wafer disposed against a wafer-mounting surface of said carrier, wherein said carrier is inserted into a cavity formed in said support housing and said cavity is subjected to pressurized air or gas in order to provide a force to maintain engagement of said wafer onto said polishing pad;

a retainer ring affixed along a periphery of said wafer-mounting surface of said carrier for retaining said wafer against said wafer-mounting surface and restricting movement of said wafer relative to said carrier, said retainer ring moving in unison with said carrier;

a flexible diaphragm for coupling said carrier to said support housing in order to permit said carrier to move relative to said support housing; and a central rigid shaft affixed to said support housing and slideable coupled to said carrier for permitting vertical movement of said carrier relative to said support housing, but restricting horizontal movement of said carrier, wherein said central shaft is coupled to a covering of said support housing at one end and the other end is extended into a recessed region disposed on said carrier, wherein said end extended into said recessed region includes a slideable coupling for permitting said carrier to move vertically relative to said central shaft.

29. The polishing head of claim 28 wherein said slideable coupling is a bushing.

30. The polishing head of claim 28 wherein said slideable coupling is a bearing.

31. The polishing head of claim 28 further including a splash diaphragm coupled to said retainer ring and said support housing in order to cover a gap between said retainer ring and said support housing, said gap being adjacent to said polishing pad.

* * * * *

UNITED STATES PATENT AND TRADEMARK OFFICE

CERTIFICATE OF CORRECTION

PATENT NO. : 6,425,812 B1
DATED : July 30, 2002
INVENTOR(S) : Anil K. Pant et al.

It is certified that error appears in the above-identified patent and that said Letters Patent is hereby corrected as shown below:

Title page,
Item [57], ABSTRACT,
Line 5, delete "move-substantially" and substitute -- move substantially -- in its place.

Column 14,
Line 52, after "thereon," delete "Wherein" and substitute -- wherein -- in its place.
Line 61, after "coupler" delete "or" and substitute -- for -- in its place.

Column 16,
Line 3, insert -- relative -- after "vertically".

Signed and Sealed this

Third Day of February, 2004

JON W. DUDAS
*Acting Director of the United States Patent and Trademark Office*